US006644681B2

(12) United States Patent
Couderc et al.

(10) Patent No.: US 6,644,681 B2
(45) **Date of Patent: *Nov. 11, 2003**

(54) SHOCK-ABSORBING SUPPORT PAD FOR A SNOWBOARD BINDING EQUIPPED WITH SUCH SUPPORT PAD

(75) Inventors: Bernard Couderc, Annecy (FR); Jean-Pierre Rigal, Mesigny (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 246 days.

(21) Appl. No.: 09/165,394

(22) Filed: Oct. 2, 1998

(65) Prior Publication Data

US 2001/0001519 A1 May 24, 2001

(30) Foreign Application Priority Data

Oct. 3, 1997 (FR) ..... 97 12738

(51) Int. Cl.[7] ..... A63C 9/10

(52) U.S. Cl. ..... 280/602; 280/607; 280/623; 280/636; 280/14.21

(58) Field of Search ..... 280/602, 607, 280/609, 14.2, 11.14, 634, 613, 636; 36/118.3, 117.1, 118.4, 118.5, 117.3

(56) References Cited

U.S. PATENT DOCUMENTS

| | | | | | |
|---|---|---|---|---|---|
| 3,448,990 | A | * | 6/1969 | Cubberley et al. | 280/636 |
| 3,905,906 | A | | 9/1975 | Edmund | 280/11.35 C |
| 3,944,238 | A | * | 3/1976 | Weigl et al. | 280/636 |
| 3,964,758 | A | * | 6/1976 | Kent | 280/613 |
| 3,988,841 | A | * | 11/1976 | Salomon | 280/613 |
| 4,383,702 | A | * | 5/1983 | Salomon | 280/611 |
| 4,889,359 | A | * | 12/1989 | Kowatsch et al. | 280/629 |
| 4,937,955 | A | * | 7/1990 | Bonaventure | 36/132 |
| 5,054,213 | A | * | 10/1991 | Bonaventure | 36/117.3 |
| 5,199,734 | A | * | 4/1993 | Mayr | 280/602 |
| 5,213,355 | A | * | 5/1993 | Juhasz | 280/602 |
| 5,303,948 | A | * | 4/1994 | Masson et al. | 280/607 |
| 5,303,950 | A | * | 4/1994 | Rigal et al. | 280/636 |
| 5,332,252 | A | * | 7/1994 | Masson et al. | 280/602 |
| 5,503,900 | A | * | 4/1996 | Fletcher | 428/160 |
| 5,564,728 | A | | 10/1996 | Renaud-Goud | 280/636 |
| 5,671,940 | A | | 9/1997 | Abondance | |
| 5,679,039 | A | * | 10/1997 | Robles | 441/70 |
| 5,743,551 | A | * | 4/1998 | Goud et al. | 280/634 |
| 5,775,717 | A | * | 7/1998 | Bobrowicz | 280/607 |
| 5,785,342 | A | * | 7/1998 | Bronson | 280/602 |
| 5,879,019 | A | | 3/1999 | Mantel | 280/620 |
| 5,909,894 | A | | 6/1999 | Meader et al. | 280/623 |
| 5,944,337 | A | * | 8/1999 | Girard et al. | 280/615 |
| 5,997,026 | A | * | 12/1999 | Klubitschko et al. | 280/607 |
| 6,022,040 | A | * | 2/2000 | Buzbee | 280/613 |
| 6,045,149 | A | * | 4/2000 | Chonier et al. | 280/636 |
| 6,247,709 | B1 | * | 6/2001 | Couderc | 280/14.21 |
| 6,328,328 | B1 | * | 12/2001 | Finiel | 280/636 |

FOREIGN PATENT DOCUMENTS

| | | | | |
|---|---|---|---|---|
| EP | 0 105 011 | * | 4/1984 | 280/613 |
| EP | 0612546 | | 8/1994 | |
| FR | 2713101 | | 6/1995 | |
| FR | 2713102 | | 6/1995 | |

* cited by examiner

*Primary Examiner*—Brian L. Johnson
*Assistant Examiner*—Bridget Avery
(74) *Attorney, Agent, or Firm*—Greenblum & Bernstein, P.L.C.

(57) ABSTRACT

Shock-absorbing support pad to be positioned between a boot and a snowboard, or between the boot and a snowboard binding, and a snowboard binding incorporating such support pad. The support pad has at least two layers of material having different hardnesses. A first layer has a support surface for contacting the boot and it has a bonding surface opposite to the support surface. A second layer is joined to the bonding surface of the first layer. The hardness of the second layer is less than the hardness of the first layer.

38 Claims, 1 Drawing Sheet

Fig: 1
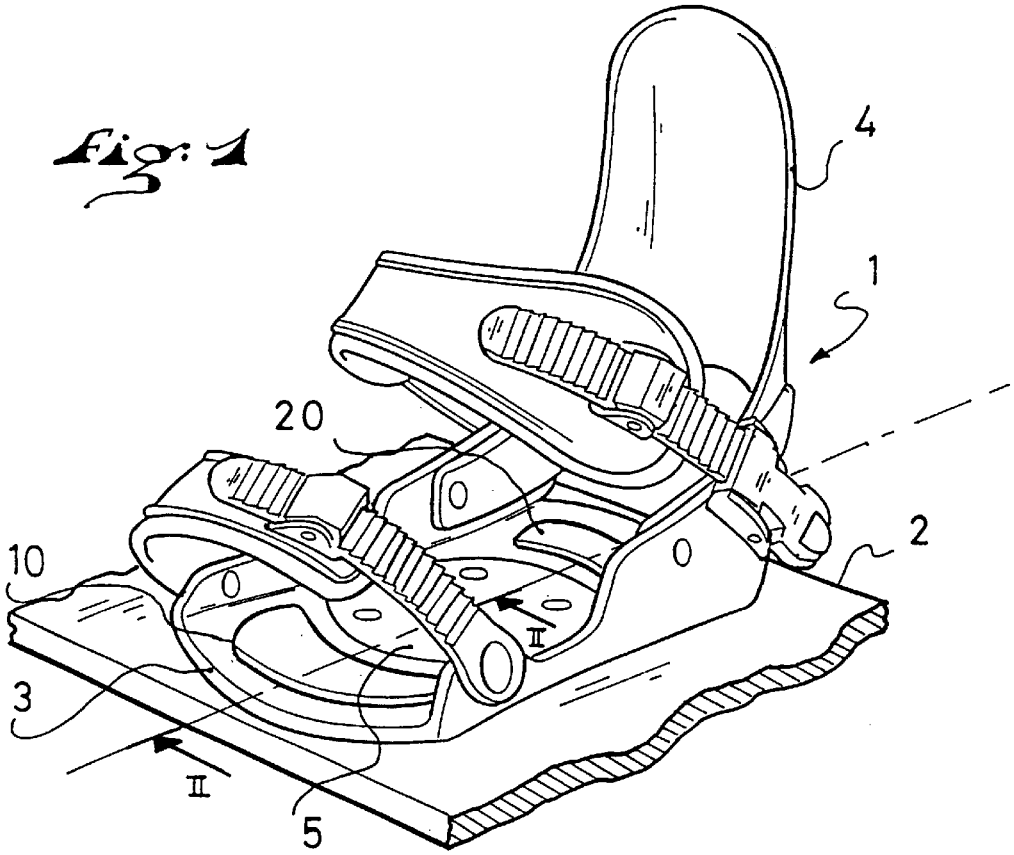
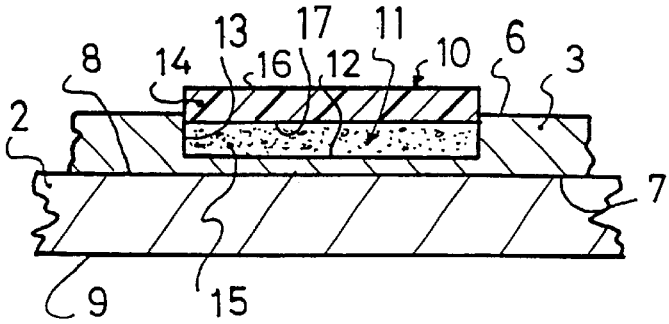
Fig: 2
Fig: 3
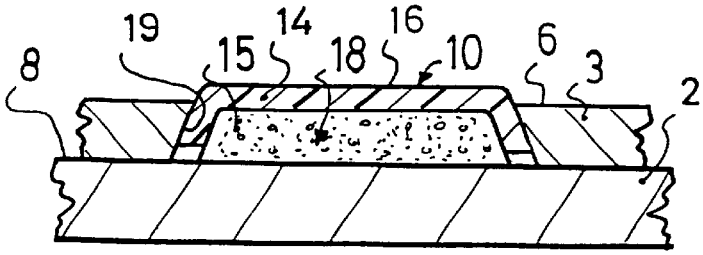

SHOCK-ABSORBING SUPPORT PAD FOR A SNOWBOARD BINDING EQUIPPED WITH SUCH SUPPORT PAD

BACKGROUND OF THE INVENTION

1. Field of the Invention

The present invention relates to the field of snowboarding and more particularly to a device for retaining a boot on a gliding board adapted for snowboarding.

2. Description of Background and Material Information

The practice of snowboarding is generally done with either rigid shell boots or flexible boots.

For flexible boots, certain retaining devices have at least one shock-absorbing support pad, generally located between a baseplate of the device and the boot when the latter is retained on the device.

The support pad is provided to improve the user's comfort and to absorb the impacts or short displacements of the boot with respect to the device.

It has been observed that certain support pad deteriorate very quickly when the device is used and, as a result, they no longer fulfill their shock-absorbing role.

It has also been observed that the support pad that resist a quick deterioration do not absorb the impacts or short displacements enough, and that these support pad do little to improve the user's comfort.

SUMMARY OF THE INVENTION

An object of the invention is to provide a support pad that improves the user's comfort and absorbs the impacts or short displacements of the boot with respect to the retaining device, i.e., the binding, while resisting the wear and abrasion caused by the boots.

Another object of the invention is to provide a retaining device having at least such a support pad.

A shock-absorbing support pad according to the invention is provided to be arranged between a boot and a board, or between the boot and a device for retaining a boot on the board, the board being adapted to snowboarding.

The support pad, according to the invention, has at least two layers of materials with a different hardness, a first layer which has a support surface provided to make contact with the boot and which has a bonding surface opposite to the support surface, and a second layer which is joined to the bonding surface from the first layer, the hardness of the second layer being less than the hardness of the first layer. This structure improves the user's comfort and absorbs the impacts or short displacements of the boot due to the second layer. Additionally, this structure offers a good resistance to the wear and abrasion caused by the boots due to the first layer.

According to a particular feature of the invention, the first layer and the second layer are glued together.

According to another feature of the invention, the first layer is made from a relatively flexible plastic material with a substantially continuous structure, and the second layer is made from a relatively flexible plastic material with a cell-type structure.

In addition to the foregoing, the invention also encompasses a device for retaining a boot on a gliding board adapted to snowboarding, the device comprising at least one shock-absorbing support pad provided to make contact with the boot, wherein the wedge comprises at least two layers of materials of a different hardness, a first layer which has a support surface provided to make contact with the boot and which has a bonding surface opposite to the support surface, and a second layer which is joined to the bonding surface of the first layer, the hardness of the second layer being less than the hardness of the first layer.

Further according to the invention, the support pad is arranged to contact a baseplate of the device, so that the first layer touches the sole of the boot when the latter is retained on the device.

Still further according to the invention, the first layer and the second layer are glued together, and the first layer is glued to the baseplate.

Still further according to the invention, the first layer of the support pad is made from a relatively flexible plastic material with a substantially continuous structure, and the second layer of the support pad is made from a relatively flexible material with a cell-type structure.

BRIEF DESCRIPTION OF DRAWINGS

Other characteristics and advantages of the invention will be better understood with the following description with reference to the attached drawings which show, by way of non-limiting examples, how the invention can be obtained, and in which:

FIG. 1 is a perspective view of a retaining device for a flexible boot, the device having two support pad;

FIG. 2 is a cross-section taken along the line II—II of FIG. 1 corresponding to a first embodiment; and FIG. 3 is similar to FIG. 2 but corresponds to a second embodiment.

DETAILED DESCRIPTION OF THE INVENTION

A retaining device or binding 1 according to the invention and shown in FIG. 1 is provided to retain, in a known manner, a boot (not shown) on a board 2. The device 1 has a baseplate 3 provided to receive the sole of the boot, as well as a rear support element 4 allowing a rear support by contact with the boot upper at the rear of the lower part of the user's leg. The device 1 is affixed to the board 2 by a disk 5 and by means for retaining the disk 5 onto the board 2.

A first embodiment of the invention is described with reference to FIG. 2.

As known, the baseplate 3 has an upper surface 6 facing the sole of the boot when the latter is retained on the device 1, as well as a lower surface 7 opposite to the upper surface 6. The board 2 has a support surface 8 opposite to a gliding surface 9, the surface 8 of the board 2 touching the lower surface 7 of the baseplate 3.

A shock-absorbing support pad 10 is housed in a closed cavity 1 of the baseplate 3, the cavity 11 having a bottom 12 and a peripheral edge 13. The support pad 10 has a first layer 14 provided to make contact with the sole, as well as a second layer 15 located between the layer 14 and the bottom 12.

A support surface 16 of the first layer 14 is upwardly exposed for contacting the sole of the boot when the latter is retained on the baseplate 3. A bonding surface 17 of the layer 14, opposite to the support surface 16 with respect to the thickness of the layer 14, is joined to the second layer 15.

Preferably, the bonding between the layers 14 and 15 is obtained by an adhesive, but any other technique could be used.

The first layer 14 is made from a relatively flexible material which resists well attrition, pulling, cutting, or other mechanical biases. It is preferably obtained from a flexible plastic material having a homogenous and continuous structure, as a polyurethane sheet, a rubber sheet or any suitable material.

For example, the layer 14 can measure between 1 and 2 mm thick and bends easily between the fingers when manipulated. Its thickness is reduced from 1% to 10% when it is subjected to a compression force which generates a stress between 50 and 100 N/cm$^2$.

The second layer 15 is made from a flexible material which has good elastic deforming and shock-absorbing abilities. The flexible material can be a foam made from a plastic material with a cell-type structure, a rubber foam, or any other suitable material such as a fiber mat.

For example, the layer 15 can measure between 2 and 10 mm thick and bends easily between the fingers when manipulated. Its thickness is reduced from 30% to 50% when it is subjected to a compression force, which generates a stress between 50 and 100 N/cm$^2$.

In any case, the second layer 15 has greater flexibility than the first layer 14.

Preferably, the wedge 10 is retained in the cavity 11 by a retaining means constituted here by gluing.

A second embodiment of the invention is seen in FIG. 3.

For convenience, the same reference numerals are used to designate the same elements or similar elements.

The support pad 10 is housed in a through cavity 18 of the baseplate 3 whose opening facing the board 2 is larger than the opening leading to the upper surface 6.

The first layer 14 is pressed against a peripheral edge 19 of the cavity 18.

The second layer 15 is arranged between the first layer 14 and the board 2.

The materials used for implementing the second embodiment are similar to those of the first embodiment.

The respective shapes of the support pad 10 and the cavity 18 allow maintaining the support pad 10 in the cavity 18.

However, it is possible to provide a complementary means for affixing such as gluing the support pad 10 to the peripheral inner surface edge 19 of the cavity 18 of the baseplate 3.

Preferably for all embodiments, the support surface 16 of the support pad 10 projects slightly with respect to the upper surface 6 of the baseplate 3. Thus, the contact between the sole and the support pad 10 is preferred with respect to a contact between the sole and the surface 6 of the baseplate 3.

When the boot takes support on the device 1, the thickness of the support pad 10 is reduced, essentially by compression of the second layer 15. Inversely, when the boot is separated from the device 1, the support pad 10 returns to its original shape due to the elasticity of the constitutive material of the second layer 15.

As seen in FIG. 1, the baseplate 3 of the device 1 has a crescent-shaped support pad 10 located substantially at the metatarsal bones of the foot, as well as a crescent-shaped support pad 20 located substantially towards the heel of the foot. The shapes of the support pad 10, 20 improve foot stability and comfort during torsional biases of the user's leg.

The invention is not limited to the embodiments described herein, and includes all technical equivalents within the scope of the following claims.

In particular, the shapes of the wedges 10, 20 and the thicknesses of their materials can vary to allow selecting specific shock-absorbing values, for example.

The shapes of the cavities 11, 18 can also vary, and possibly be different from the shapes of the support pad 10, 20.

The bonding surface 17 of the first layer 14 can be planar as in the first embodiment, curved inward as in the second embodiment, or have any suitable shape.

Furthermore, each support pad 10, 20 can have additional layers which, in this case, would be located between the second layer 15 and the bottom 12, or between the second layer 15 and the surface 8 of the board 2.

This application is based upon French Patent Application No. 97 12738, filed Oct. 3, 1997, the disclosure of which is hereby incorporated by reference thereto in its entirety, and the priority of which is hereby claimed under 35 USC 119.

What is claimed is:

1. A shock-absorbing support pad adapted to be arranged between a boot and a snowboard or between the boot and a binding for retaining the boot on the snowboard, said support pad comprising:

at least two layers of materials having different hardnesses, said at least two layers comprising:

a first layer having a support surface positioned for contact with the boot, said first layer having a bonding surface opposite to said support surface, said first layer being made of a relatively flexible plastic material with a substantially continuous structure; and a second layer joined to said bonding surface of said first layer, said second layer being made of a relatively flexible plastic material, said second layer having a hardness less than a hardness of said first layer, and said second layer having a greater flexibility than a flexibility of said first layer.

2. A shock-absorbing support pad according to claim 1, wherein:

said first layer and said second layer joined together with adhesive.

3. A shock-absorbing pad according to claim 1, wherein:

said flexible plastic material of said second layer comprises a cell-type structure.

4. A shock-absorbing pad according to claim 1, wherein:

said first layer has a thickness of between 1 and 2 millimeters.

5. A shock-absorbing support pad according to claim 1, wherein:

said support pad consists of said first and second layers of materials.

6. A shock-absorbing pad according to claim 4, wherein:

said material of said first layer is compressible between 1% and 10% when subjected to a compressive force of between 50 and 100 N/cm$^2$.

7. A shock-absorbing pad according to claim 6, wherein:

said second layer has a thickness of between 1 and 10 millimeters.

8. A shock-absorbing pad according to claim 7, wherein:

said material of said second layer is compressible between 30% and 50% when subjected to a compressive force of between 50 and 100 N/cm$^2$.

9. A binding for retaining a boot on a snowboard, said binding comprising:

a shock-absorbing support pad adapted to directly contact the boot, said support pad comprising at least two layers of materials having different hardnesses, said at least two layers comprising:

a first layer having a support surface positioned for contact with the boot, said first layer having a bonding surface opposite to said support surface, said first layer being made of a relatively flexible plastic material with a substantially continuous structure; and a second layer joined to said bonding surface of said first layer, said second layer being made of a relatively flexible plastic material, said second layer having a hardness less than a hardness of said first layer, and said second layer having a greater flexibility than a flexibility of said first layer.

10. A binding according to claim 9, wherein:

said first layer and said second layer joined together with adhesive.

11. A binding according to claim 9, wherein:

said flexible plastic material of said second layer comprises a cell-type structure.

12. A binding according to claim 9, wherein:

said first layer has a thickness of between 1 and 2 millimeters.

13. A binding according to claim 9, wherein:

said shock-absorbing support pad consists of said first and second layers of materials.

14. A binding according to claim 12, wherein:

said material of said first layer is compressible between 1% and 10% when subjected to a compressive force of between 50 and 100 N/cm$^2$.

15. A binding according to claim 14, wherein:

said second layer has a thickness of between 1 and 10 millimeters.

16. A binding according to claim 15, wherein:

said material of said second layer is compressible between 30% and 50% when subjected to a compressive force of between 50 and 100 N/cm$^2$.

17. A device for retaining a boot on a snowboard, said device comprising:

a baseplate for receiving the boot, said baseplate extending at least between a substantially metatarsal area and a substantially heel area, said baseplate having at least one upper surface;

at least one shock-absorbing support pad projecting from said upper surface of said baseplate, said support pad having an exposed upper support surface for contacting the boot at at least one of said metatarsal area and said heel area;

said support pad comprising at least two layers of materials of different hardnesses, a first of said two layers being made of a relatively flexible plastic material and comprising said exposed upper support surface for contacting the boot and a bonding surface opposite to said support surface, a second of said two layers being joined to said bonding surface of said first layer, said second layer having a hardness less than a hardness of said first layer.

18. A device for retaining a boot on a snowboard according to claim 17, wherein:

said at least one shock-absorbing support pad comprises two spaced-apart shock-absorbing support pads, a first of said two shock-absorbing pads projecting from said upper surface of said baseplate for contacting the boot at said metatarsal area and a second of said two shock-absorbing pads projecting from said upper surface of said baseplate for contacting the boot at said heel area.

19. A device for retaining a boot on a snowboard according to claim 17, wherein:

said baseplate includes a closed cavity having a bottom recessed below said upper surface of said baseplate; and said shock-absorbing support pad is housed in said closed cavity of said baseplate.

20. A device for retaining a boot on a snowboard according to claim 17, wherein:

said first layer and said second layer joined together with adhesive.

21. A device for retaining a boot on a snowboard according to claim 17, wherein:

said first layer comprises a substantially continuous structure;

said second layer of said support pad is joined to said bonding surface of said first layer, said second layer being made of a relatively flexible plastic material, said second layer having a hardness less than a hardness of said first layer, and said second layer having a greater flexibility than a flexibility of said first layer, said flexible plastic material of said second layer comprising a cell-type structure.

22. A device for retaining a boot on a snowboard according to claim 17, further comprising:

a mechanism to affix said baseplate to the snowboard.

23. A device for retaining a boot on a snowboard according to claim 22, wherein:

said mechanism comprises a disk and means for retaining said disk onto the snowboard.

24. A device for retaining a boot on a snowboard according to claim 17, wherein:

said support pad consists of said two layers of materials.

25. A device for retaining a boot on a snowboard, said device comprising:

a baseplate extending at least between a substantially metatarsal area and a substantial heel area, said baseplate having at least one upper surface;

at least one shock-absorbing support pad projecting from said upper surface of said baseplate, said support pad having an exposed upper support surface for contacting the boot at at least one of said metatarsal area and said heel area;

said support pad comprising at least two layers of materials of different hardnesses, a first of said two layers being made of a relatively flexible plastic material and comprising said exposed upper support surface for contacting the boot and a bonding surface opposite to said support surface, a second of said two layers being joined to said bonding surface of said first layer, said second layer having a hardness less than a hardness of said first layer of said at least one shock-absorbing pad;

wherein said baseplate includes a through cavity extending between said upper surface to a lower surface of said baseplate; and wherein said shock-absorbing support pad is housed in said through cavity of said baseplate.

26. A device for retaining a boot on a snowboard according to claim 25, wherein:

said first layer is glued to a peripheral inner surface of said through cavity.

27. A device for retaining a boot on a snowboard according to claim 25, wherein:

said support pad consists of said first and second layers.

28. A device for retaining a boot on a snowboard, said device comprising:

a baseplate extending at least between a substantially metatarsal area and a substantially heel area, said baseplate having at least one upper surface;

at least one shock-absorbing support pad projecting from said upper surface of said baseplate, said support pad having an exposed upper support surface for contacting the boot at at least one of said metatarsal area and said heel area;

said support pad comprising at least two layers of materials of different hardnesses, a first of said two layers being made of a relatively flexible plastic material and comprising said exposed upper support surface for contacting the boot and a bonding surface opposite to said support surface, a second of said two layers being joined to said bonding surface of said first layer, said second layer having a hardness less than a hardness of said first layer of said at least one shock-absorbing pad;

wherein said baseplate includes a through cavity extending between said upper surface to a lower surface of said baseplate;

wherein said shock-absorbing support pad is housed in said through cavity of said baseplate; and wherein said shock-absorbing support pad has a lowest extent flush with said lower surface of said baseplate.

29. A device for retaining a boot on a snowboard, said device comprising:

a baseplate for receiving the boot, said baseplate extending at least between a substantially metatarsal area and a substantially heel area, said baseplate having at least one upper surface;

at least one shock-absorbing support pad having a portion projecting upwardly beyond said upper surface of said baseplate, said support pad having an exposed upper support surface for contacting the boot at at least one of said metatarsal area and said heel area;

said shock-absorbing support pad comprising at least two layers of supple materials of different hardnesses, a first of said two layers comprising said exposed upper support surface for contacting the boot and a bonding surface opposite to said support surface, a second of said two layers being joined to said bonding surface of said first layer, said second layer having a hardness less than a hardness of said first layer.

30. A device for retaining a boot on a snowboard according to claim 29, wherein:

said support pad consists of said first and second layers.

31. A device for retaining a boot on a snowboard according to claim 29, wherein:

said baseplate includes at least one through cavity extending between said upper surface to a lower surface of said baseplate; and said shock-absorbing support pad is housed in said through cavity of said baseplate.

32. A device for retaining a boot on a snowboard according to claim 29, wherein:

said at least one shock-absorbing support pad comprises at least two shock-absorbing pads having respective portions projecting upwardly beyond said upper surface of said baseplate, each of said support pads having an exposed upper support surface for contacting the boot at a respective one of said metatarsal area and said heel area.

33. A device for retaining a boot on a snowboard according to claim 29, wherein:

said second layer comprises a compressible cellular foam material.

34. A device for retaining a boot on a snowboard according to claim 29, wherein:

said first layer of said at least one shock-absorbing pad has a thickness of between 1 and 2 millimeters.

35. A device for retaining a boot on a snowboard according to claim 34, wherein:

said material of said first layer is compressible between 1% and 10% when subjected to a compressive force of between 50 and 100 $N/cm^2$.

36. A device for retaining a boot on a snowboard according to claim 35, wherein:

said second layer has a thickness of between 1 and 10 millimeters.

37. A device for retaining a boot on a snowboard according to claim 36, wherein:

said material of said second layer is compressible between 30% and 50% when subjected to a compressive force of between 50 and 100 $N/cm^2$.

38. A device for retaining a boot on a snowboard, said device comprising:

a baseplate for receiving the boot, said baseplate extending at least between a substantially metatarsal area and a substantially heel area, said baseplate having at least one upper surface;

at least one shock-absorbing support pad having a portion projecting upwardly beyond said upper surface of said baseplate, said support pad having an exposed upper support surface for contacting the boot at at least one of said metatarsal area and said heel area;

said shock-absorbing support pad comprising at least two layers of supple materials of different hardnesses, a first of said two layers comprising said exposed upper support surface for contacting the boot and a bonding surface opposite to said support surface, a second of said two layers being joined to said bonding surface of said first layer, said second layer having a hardness less than a hardness of said first layer;

wherein said baseplate includes at least one through cavity extending between said upper surface to a lower surface of said baseplate;

wherein said shock-absorbing support pad is housed in said through cavity of said baseplate; and wherein said shock-absorbing support pad has a lowest extent flush with said lower surface of said baseplate, said lower surface of said baseplate to be supported directly on an upper surface of the snowboard.

* * * * *